United States Patent [19]

Gerhard

[11] Patent Number: 4,955,956

[45] Date of Patent: Sep. 11, 1990

[54] TRANSPORT TANK

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 400,682

[22] Filed: Aug. 30, 1989

[30] Foreign Application Priority Data

Aug. 31, 1988 [DE] Fed. Rep. of Germany ..... 8811024

[51] Int. Cl.[5] ..... B65D 7/90

[52] U.S. Cl. ..... 220/562; 220/1 B; 220/5 A

[58] Field of Search ..... 220/1 B, 1.5, 5 A

[56] References Cited

U.S. PATENT DOCUMENTS

| | | | |
|---|---|---|---|
| 2,477,831 | 8/1949 | Schmitz, Jr. | 220/1 B |
| 3,730,384 | 5/1973 | Ramme | 220/1 B X |
| 3,971,491 | 7/1976 | Mowatt-Larssen | 220/1.5 X |
| 4,065,022 | 12/1977 | Cainaud | 220/1 B X |
| 4,307,012 | 12/1981 | Gerhard | 220/1.5 |
| 4,412,626 | 11/1983 | Gerhard | 220/1.5 |
| 4,591,064 | 5/1986 | Gerhard | 220/1.5 |
| 4,593,832 | 6/1986 | Gerhard | 220/1.5 |
| 4,615,453 | 10/1986 | Taquoi | 220/1 B X |
| 4,728,000 | 3/1988 | Gerhard | 220/1 B X |
| 4,753,363 | 6/1988 | Gerhard | 220/1 B X |

*Primary Examiner*—Steven M. Pollard

*Attorney, Agent, or Firm*—Evenson, Wands, Edwards, Lenahan & McKeown

[57] ABSTRACT

An swap tank, which is suited for being used in connection with two different locking modules of ISO container vehicles, includes a bottom frame with two frame portions each of which consists of a lower transverse beam (15) and two longitudinal beams (16) that extend only over part of the tank length. An end ring element (18) welded to each tank end bottom (12) is connected to the transverse beam (15) by triangular saddle piece (23) placed on the transverse beam (15). The longitudinal beam (16) is connected to a reinforcing ring (14) surrounding the tank at its end remote from the transverse beam (15) and to a further reinforcing ring (13) at an intermediate location. The portion of the longitudinal beam (16) between the two reinforcing rings (13,14) serves for engagement by a grappler arm. Outer corner fittings (17) are provided on the underside of the transverse beam (15) at both ends thereof. Inner corner fittings (28) are provided on the underside of each longitudinal beam (16) at the location where the latter is connected to the outer reinforcing ring (13). In the longitudinal direction of the tank, the mutual spacing between the two outer corner fittings (17) is 30′ (approx. 9125 mm) and between the inner corner fittings (28) is 20′ (approx. 6058 mm).

8 Claims, 1 Drawing Sheet

TRANSPORT TANK

This invention relates to a transport tank, specifically a so-called swap tank. Swap tanks are transport tanks which resemble tank containers and permit interchange between transport modes. They are predominantly used in the combined or multi-mode road or rail transport of liquids, gases and bulk material.

U.S. Patent Specification No. 4,593,832 discloses a transport tank having a cylindrical body and curved end bottoms each connected by means of an end ring element and saddle pieces to frame portions that are provided with outer corner fittings. Each end ring element has a flange extending parallel to the longitudinal axis of the tank and welded to the respective end bottom, and each saddle piece has a triangular wall portion extending transverse of the axis and connected to a radially extending flange of the end ring element, an edge of the wall portion being provided with a further flange connected to the respective frame portion.

The known structure is a fully stackable ISO tank container in which the outer frame, which in even earlier designs completely surrounds the tank, has been reduced to two end frames each of which has four corner fittings and is connected by means of four saddle pieces and an end ring to the respective outwardly curved end bottom of the tank.

SUMMARY OF THE INVENTION

It is an object of the present invention to provide a swap tank which, on the one hand, has an even smaller tare weight and, on the other hand, ensures all forces exerted on the tank to be safely transmitted to the lower corner fittings of a frame structure and at the same time permits the tank to be selectively coupled to twist locks or other locking elements provided at various spacings on the respective vehicle platform.

To meet this object, the transport tank of the present invention includes a cylindrical body and curved end bottoms each connected by an end ring element and saddle pieces to a frame portion which is provided with outer corner fittings. Each end ring element havs a flange extending parallel to the longitudinal tank axis and welded to the respective end bottom. Each saddle piece has a triangular wall portion extending transversely of the tank axis and connected to a radially extending flange of the end ring element, and a flange provided at an edge of the wall portion and connected to the respective frame portion. The end ring element is formed as a partial ring extending through a range of about 90° to about 180° of the lower half of the tank end bottom. Each frame portion includes a lower transverse beam having its upper surface connected to the saddle pieces and two lower longitudinal beams extending over part of the tank length. Each longitudinal beam is provided with a further, inner corner fitting and connected to a reinforcing ring surrounding said tank body. The inner edge of the triangular wall portion of each saddle piece adjacent the tank extends substantially tangentially of the end bottom.

The tank structure of the invention results in an endwise and lengthwise support arrangement virtually restricted to a minimum of structural parts and dimensions sufficient for transmitting the forces exerted on the tank. At the same time, fixing locations for outer and inner corner fittings are achieved at the outer ends of the transverse and longitudinal beams and at those locations at which the longitudinal beams are connected to reinforcing rings. The transport tank of the invention thus includes a total of eight lower corner fittings mutually spaced in the longitudinal direction of the tank in accordance with two different spacings of locking elements commonly provided on vehicles.

In a preferred embodiment of the invention, the outer corner fittings are spaced 30′ (approx. 9125 mm), and the inner corner fittings are spaced 20′ (approx. 6058 mm).

Further preferred embodiments of the invention aim at providing additional reinforcing and stiffening of the saddle and frame structures, avoiding peak stresses at the ends of the end ring elements, and increasing the flexibility of tank handling.

Further objects and advantages of the invention will become apparent from the following description in connection with the drawing.

DESCRIPTION OF A PREFERRED EMBODIMENT

Figure 1:
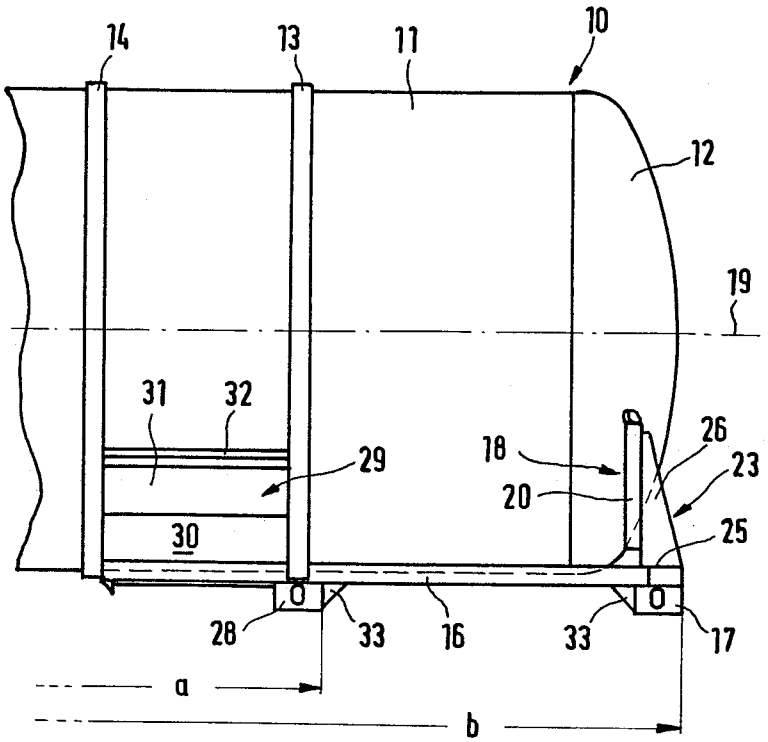
FIG. 1 is a side-view of part of a transport tank.

Referring to the drawing, the tank 10 is made of a circular-cylindrical body 11 and curved end bottoms 12 only one of which is shown in FIG. 1. The body 11 is surrounded by a number of reinforcing rings 13, 14. FIG. 1 shows only the right-hand part of the tank 10. The vertical center plane of the tank 10 is situated further to the left of the reinforcing ring 14 and thus not seen in the drawing.

In the end region shown in FIG. 1, the tank 10 is received by a frame portion which includes a transverse beam 15 and two longitudinal beams 16. An outer corner fitting 17 is welded to the underside of the transverse beam 15 at both outer ends thereof.

An end ring element 18 of L-shaped cross-section is fixed to the end bottom 12. A flange 20 of the ring element 18 extending parallel to the longitudinal tank axis 19 is welded to the knuckle zone, which is the zone of smallest radius of curvature of the end bottom, or to the less curved area within such knuckle zone. The end ring element 18 extends through an angle of 135° and is symmetrically disposed with respect to the vertical longitudinal center plane of the tank 10. To avoid peak stresses, both ends of the flange 20 are welded to the outer surfaces of tubular elements 21 radially disposed on the end bottom 12. The elements 21 have bevelled outer ends to reduce stresses even further. Instead of the L-shaped cross-section, the end ring element 18 may be have a T-shaped cross-section with the central web joined to the end bottom 12. In any case, the ring element 18 has a radially extending flange 22.

Two triangular saddle pieces 23 are mounted on the transverse beam 15. Each saddle piece 23 has a triangular wall portion 24 extending perpendicularly to the longitudinal tank axis 19 and abutting the radial flange 22 of the ring element 18. A horizontal flange 25 is formed by bending at the lower edge of the wall portion 24. The flange 25 overlies the upper surface of the transverse beam 15.

A stiffening flange 26 is formed by bending at the oblique edge of the wall portion 24 remote from the tank 10. The flange 26 may be triangular or trapezoidal with a long lower edge connected to the flange 25. The third edge of the wall portion 24 facing the tank extends tangentially of the end bottom 12 and reaches it as far as possible so as to achieve maximum overlapping between the wall portion 24 and the flange 22 of the ring element 18.

The shape of the end ring element 18 and of the saddle piece 23 described above permit the assembly of the transport tank by placing both frame portions with respect to the tank 10 so that the outer corner fittings 17 are disposed at the prescribed standard spacing in the longitudinal direction of the tank, whereupon the saddle pieces 23 are moved in the longitudinal direction until the wall portions 24 abut the flange 22 of the ring element 18, which was previously welded to the tank end bottom 12. In this condition, the saddle pieces 23 are welded or screwed to the ring element 18 and the transverse beam 15. Tolerances may thereby be compensated which are unavoidable in the manufacture of the individual parts, particularly of the tank 10 itself, and in welding the ring elements 18 to the end bottoms 12.

The triangular shape of the saddle pieces 23 is advantageous not only with respect to saving material and weight but also because it corresponds to the direction of the forces that are to be transmitted from the tank 10 directly to the corner fittings 17.

A rectangular junction plate 27 may be provided between the two triangular saddle pieces 23 for further support of the tank 10. The plate 27 has a vertically extending wall portion welded or screwed to the radial flange 22 of the end ring element 18 and a lower bent flange welded or screwed to the upper surface of the transverse beam 15.

The longitudinal beams 16 have their inner ends abutting the reinforcing ring 14 and are connected at an intermediate location to the reinforcing ring 13. An inner corner fitting 28 is mounted at the underside of each longitudinal beam 16 at the connecting location between the latter and the reinforcing ring 13.

The spacing a between the inner corner fitting 28 shown in FIG. 1 and the inner corner fitting (not shown) provided symmetrically at the other end of the tank 10 is preferably 20′ (approx. 6058 mm). Further, the spacing between the inner corner fitting 28 and the outer corner fitting 17 is preferably 5′ (approx. 1534 mm), which results in a spacing b =30′ (approx. 9125 mm) between the outer corner fitting 17 shown in FIG. 1 and the outer corner fitting (not shown) disposed symmetrically at the other end of the tank. These spacings are useful because twistlocks or other locking elements provided on vehicles designed for the transport of ISO containers are usually disposed at one of these spacings. The transport tank shown may thus be mounted on vehicles designed for 20′ containers just as on those designed for 30′ containers.

The portion of the longitudinal beam 16 between the two reinforcing rings 13, 14 serves for engagemant by a grapppler arm. In this area, a plate 29 is inserted, which has a vertical wall portion 30 adjoining the upper edge of the longitudinal beam 16 and serving as the required sliding surface for the grappler arm. A radially extending wall portion 31 is formed integrally with the wall portion 30 by bending, the wall portion 31 being connected to an outwardly extending web of a T-bar 32 welded to the shell of the tank 10 between the two reinforcing rings 13, 14.

Figure 2:
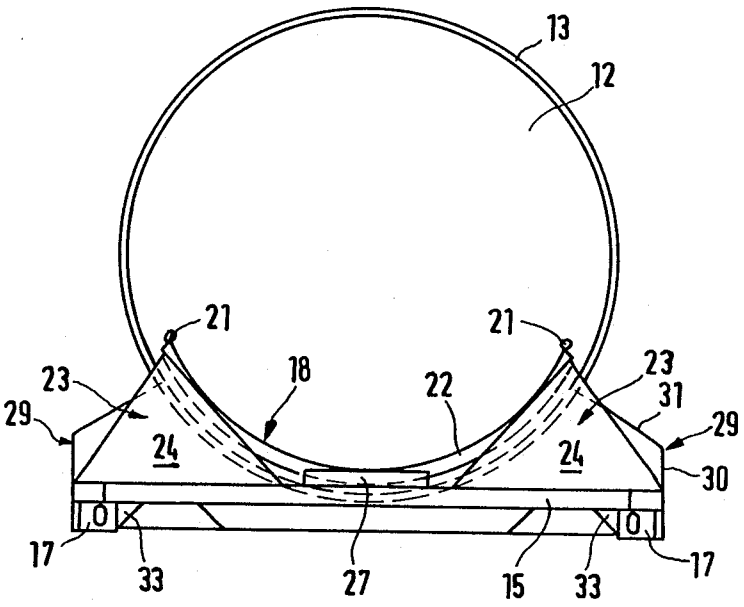
FIG. 2 is an end-view of the tank shown in FIG. 1.

As shown in FIGS. 1 and 2, the outer and inner corner fittings 17, 28 may be additionally supported on the longitudinal beam 16 and the transverse beam 15 by means of bevelled consoles 33.

The transverse and longitudinal beams may be formed of rectangular cross-section material, of vertically disposed I-beams or of inwardly or outwardly open U-beams produced from hot-rolled normal steel.

I claim:

1. A transport tank including a cylindrical body defining a longitudinal tank axis, said body having curved end bottoms and a reinforcing ring surrounding said body, a pair of frame portions each including a lower transverse beam provided with a pair of outer corner fittings, and two lower longitudinal beams extending over part of the tank length, each longitudinal beam being provided with an inner corner fitting and connected to said reinforcing ring, a pair of end ring elements each formed as a partial ring extending through a range of about 90° to about 180° of the lower half of the end bottom, each end ring element having a radial flange and a flange extending parallel to said tank axis and being welded to a respective end bottom, and saddle pieces each having a triangular wall portion extending transverse of said tank axis adjacent said tank and substantially tangentially of a respective end bottom, said triangular wall portion being connected to said radial flange of a respective end ring element, and a flange provided at an edge of the wall portion and connected to a respective transverse beam.

2. The transport tank of claim 1, wherein the outer edge of said triangular wall portion of each saddle piece remote from said tank extends downwardly and outwardly and is formed with a stiffening flange.

3. The transport tank of claim 1, wherein said end ring element has its lower central portion supported by a rectangular junction plate which has a lower flange sitting on said transverse beam.

4. The transport tank of claim 1, wherein the ends of said end ring element are each connected to the outer surface of a tubular element welded to said end bottom.

5. The transport tank of claim 1, wherein each longitudinal beam has its inner end connected to a first reinforcing ring and an intermediate portion connected to a second reinforcing ring, said inner corner fitting being connected to said longitudinal beam at the location of said second reinforcing ring.

6. The transport tank of claim 5, wherein the portion of each longitudinal beam disposed between said two reinforcing rings is formed for engagement by a grappler arm and provided with an upwardly extending sliding plate.

7. The transport tank of claim 6, wherein said sliding plate has a bent wall portion extending radially inwardly of said tank and connected to a bar mounted on said tank body between said two reinforcing rings.

8. The transport tank of claim 1, wherein the mutual spacing as measured in the longitudinal direction of said tank is 30′ (approx. 9124 mm) between said outer corner fittings and is 20′ (approx. 6058 mm) between said inner corner fittings.

* * * * *